US008955598B2

(12) United States Patent
Brown et al.

(10) Patent No.: US 8,955,598 B2
(45) Date of Patent: Feb. 17, 2015

(54) SHROUD HAVING SEPARATE UPPER AND LOWER PORTIONS FOR SUBMERSIBLE PUMP ASSEMBLY AND GAS SEPARATOR

(75) Inventors: Donn J. Brown, Broken Arrow, OK (US); Brown L. Wilson, Tulsa, OK (US); Michael J. Fox, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 293 days.

(21) Appl. No.: 13/617,666

(22) Filed: Sep. 14, 2012

(65) Prior Publication Data

US 2013/0068455 A1 Mar. 21, 2013

Related U.S. Application Data

(60) Provisional application No. 61/536,839, filed on Sep. 20, 2011.

(51) Int. Cl.

| | |
|---|---|
| ***E21B 43/00*** | (2006.01) |
| ***F04B 23/00*** | (2006.01) |
| ***F04B 35/04*** | (2006.01) |
| ***E21B 43/12*** | (2006.01) |
| ***E21B 36/00*** | (2006.01) |
| ***E21B 43/38*** | (2006.01) |

(52) U.S. Cl.

CPC ..... *E21B 43/121* (2013.01); *E21B 36/006* (2013.01); *E21B 43/38* (2013.01); *E21B 43/128* (2013.01)

USPC ..... 166/369; 166/105.5; 166/106; 166/265; 417/313; 417/424.2

(58) Field of Classification Search

USPC ..... 166/265, 378, 105.5, 106, 66.4, 62, 166/369; 417/313, 424.2

See application file for complete search history.

(56) References Cited

U.S. PATENT DOCUMENTS

| | | | | |
|---|---|---|---|---|
| 4,537,257 | A * | 8/1985 | Todd | 166/369 |
| 4,749,034 | A * | 6/1988 | Vandevier et al. | 166/105 |
| 6,260,619 | B1 * | 7/2001 | Svedeman et al. | 166/265 |
| 6,260,627 | B1 * | 7/2001 | Rivas | 166/369 |
| 6,412,563 | B1 * | 7/2002 | William St. Clair et al. | 166/372 |
| 6,691,782 | B2 * | 2/2004 | Vandevier | 166/265 |
| 7,377,313 | B2 * | 5/2008 | Brown et al. | 166/105.5 |
| 7,736,133 | B2 * | 6/2010 | Martinez | 417/423.3 |
| 7,766,081 | B2 | 8/2010 | Brown et al. | |
| 8,079,418 | B2 | 12/2011 | Brown et al. | |
| 8,141,625 | B2 * | 3/2012 | Reid | 166/105.5 |
| 8,196,657 | B2 * | 6/2012 | Kennedy | 166/265 |
| 8,397,811 | B2 * | 3/2013 | Reid | 166/265 |
| 8,747,078 | B2 * | 6/2014 | Brown et al. | 417/313 |
| 2003/0221827 | A1 * | 12/2003 | Brady et al. | 166/265 |
| 2004/0074390 | A1 * | 4/2004 | Ford et al. | 95/260 |
| 2005/0281683 | A1 * | 12/2005 | Brown et al. | 417/313 |

(Continued)

*Primary Examiner* — Jennifer H Gay

(74) *Attorney, Agent, or Firm* — Bracewell & Giuliani LLP

(57) ABSTRACT

A downhole well pumping assembly has a shroud with an upper section and a lower section sealed from one another. A submersible pump and a gas separator are housed within the upper section of the shroud. The gas separator has a liquid outlet in fluid communication with an intake of the pump, and a gas outlet in fluid communication with the gas outlet in the shroud. A motor is housed within the lower section of the shroud, the motor being coupled to the gas separator for rotating the gas separator and the pump. A well fluid lower inlet is in the shroud below the motor and a well fluid lower outlet is in the shroud above the motor.

20 Claims, 6 Drawing Sheets

(56) References Cited

U.S. PATENT DOCUMENTS

2009/0065202 A1* 3/2009 Brown et al. ..... 166/267
2009/0272538 A1* 11/2009 Kennedy ..... 166/369
2010/0319926 A1* 12/2010 Reid ..... 166/372
2011/0162832 A1* 7/2011 Reid ..... 166/105.5
2013/0068455 A1* 3/2013 Brown et al. ..... 166/265

* cited by examiner

FIG. 5
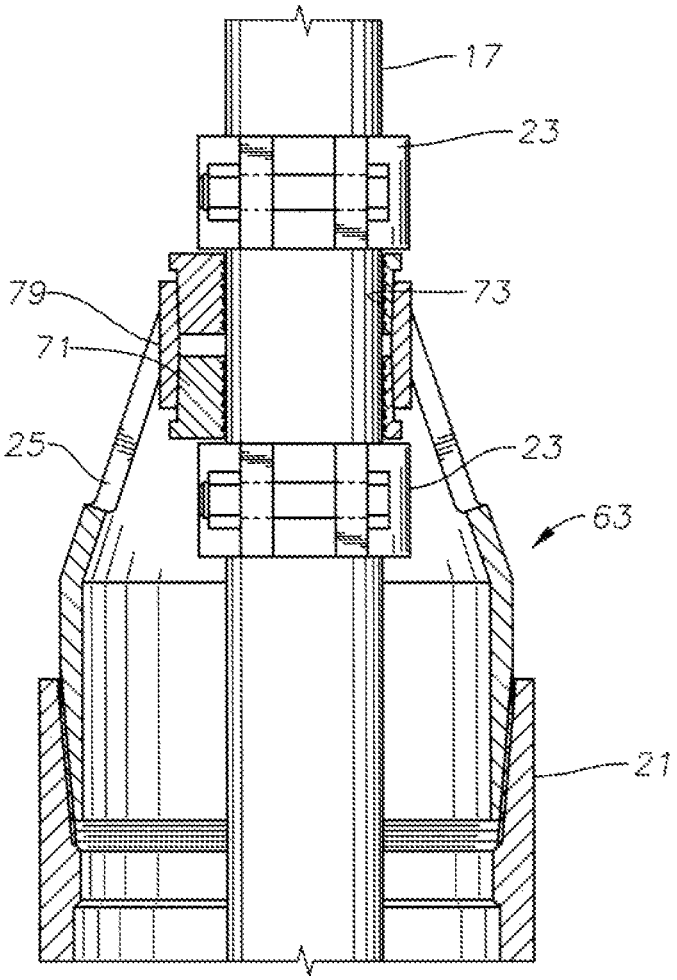
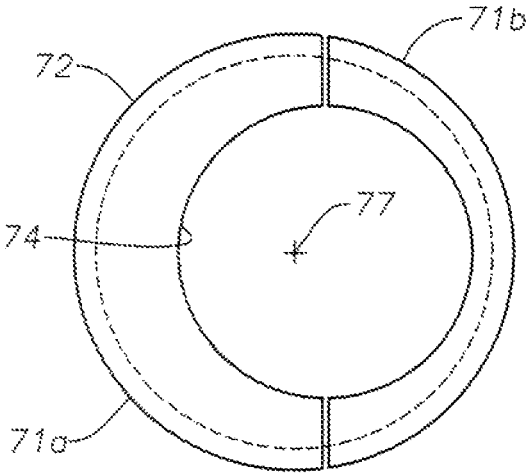
FIG. 6
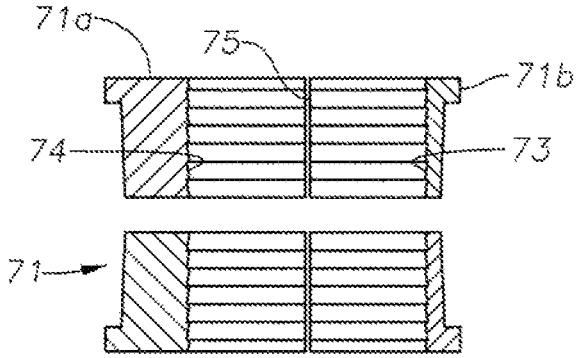
FIG. 7

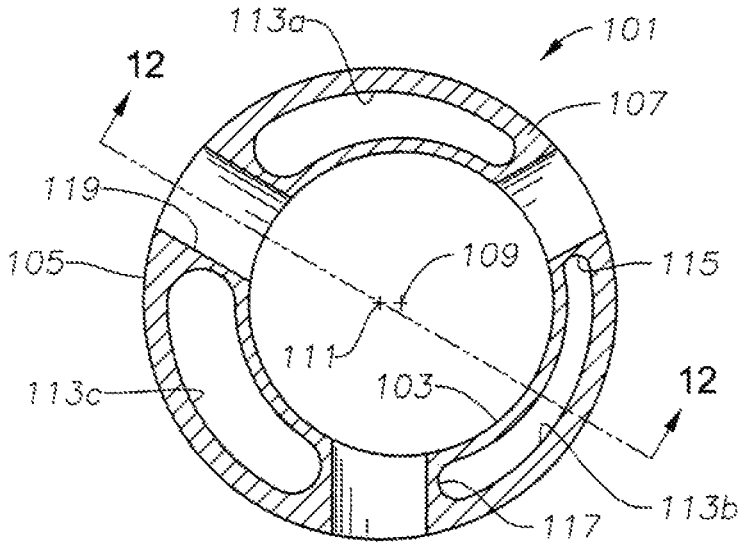
FIG.11
FIG.9
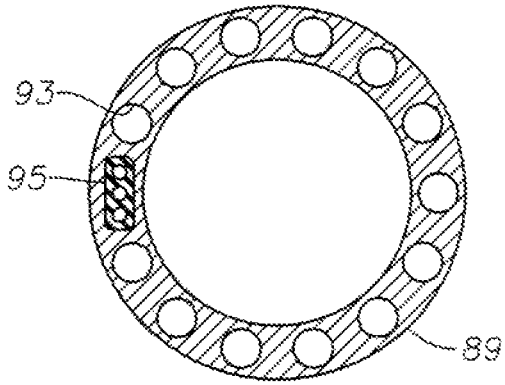
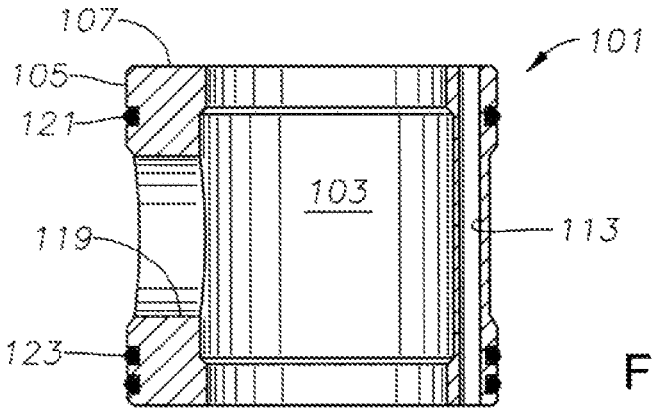
FIG.12

SHROUD HAVING SEPARATE UPPER AND LOWER PORTIONS FOR SUBMERSIBLE PUMP ASSEMBLY AND GAS SEPARATOR

CROSS-REFERENCE TO RELATED APPLICATION

This application claims priority to provisional application Ser. No. 61/536,839, filed Sep. 20, 2011.

FIELD OF THE DISCLOSURE

This invention relates in general to hydrocarbon well equipment and in particular to a shrouded electrical submersible pump for producing methane from hydrates.

BACKGROUND

Some wells produce gas and liquid that is primarily water. The well may have insufficient formation pressure to cause the water to flow to the surface. If not conveyed to the surface, the liquid will build up and block flow of the gas. A variety of techniques are employed to pump the water from the well while allowing the gas to flow. For example, an electrical submersible pump might be installed on a string of tubing to pump the water up the tubing while the gas flows up the annulus.

Electrical submersible pumps, however, do not efficiently pump a mixture of liquid and gas, thus provisions may be required to separate the gas from the liquid. The pump may be housed within a shroud that is suspended in the well on the string of tubing and has an open upper end. The mixed gas and liquid fluid flows up the outer annulus alongside the shroud, then down the inner annulus between the pump and the shroud. As the direction of flow changes, some of the gas is separated from the mixed flow and flows up the outer annulus. The more dense fluid flow down to the intake of the pump, which pumps the more dense fluid up the string of tubing.

U.S. Pat. No. 7,766,081 discloses employing a rotary gas separator to cause additional gas separation of the downward flowing fluid in the inner annulus of the shroud. The rotary gas separator is rotated by the motor. Which is suspended below the shroud. A drive shaft extends through the gas separator to the pump connected to the upper end of the gas separator. The motor rotates vanes within the gas separator to force the liquids to the outer part of the housing of the separator while the gas flows up a central area. A crossover member at the upper end of the separator directs the gas through lateral tubes and out ports in the side wall of the shroud to the outer annulus. The crossover member directs the liquid to the pump, which pumps the liquid up the string of tubing to the surface.

In U.S. Pat. No. 7,766,081, the motor is located entirely below the shroud. The motor relies on the well fluid flowing upward past it for cooling. In some instances, the upward flow may be inadequate. Also, in U.S. Pat. No. 7,766,081, the lateral tubes extending from the cross-over member must be oriented with the gas outlets. Orienting requires that the pump and gas separator be assembled in the shroud before that portion of the shroud is lowered into the well.

Also, in some well production, such as methane from shallow wells, heat must be applied to the well fluid to cause the flow. Provisions to include a heater must account for the shroud, if a shroud for gas separation is employed.

SUMMARY

The well fluid pumping apparatus of this disclosure has a shroud for support by a string of tubing within a well to define an outer annulus surrounding the shroud. The shroud has an upper section and a lower section sealed from one another, the upper section having an upper inlet and a gas outlet. A submersible pump is housed within the upper section of the shroud and has an upper end for connection to the string of tubing. A gas separator is connected to a lower end of the pump and housed within the upper section of the shroud. The gas separator has an intake at a lower end of the gas separator in fluid communication with well fluid in the shroud entering through the upper inlet. The gas separator has a liquid outlet in fluid communication with an intake of the pump, and a gas outlet in fluid communication with the gas outlet in the shroud. A motor is housed within the lower section of the shroud, the motor being coupled to the gas separator for driving the gas separator and the pump. A well fluid lower inlet is in the shroud below the motor and a well fluid lower outlet above the motor in the lower section of the shroud for flowing well fluid into the shroud and past the motor to the well fluid lower outlet.

A well fluid bypass member has a bore in which a portion of the gas separator is located, defining a wall between the bore and an exterior of the bypass member. A plurality of well fluid passages extend through the wall of the bypass member from the upper end to the lower end of the bypass member to define the well fluid flow path to the intake of the gas separator. At least one gas passage extends through the wall of the bypass member from the bore to the exterior, the gas passage being in fluid communication with the gas outlet of the gas separator and the gas outlet of the shroud. A bypass member upper seal seals between the bypass member and the shroud above the gas outlet of the shroud. A bypass member lower seal seals between the bypass member and the shroud below the gas outlet of the shroud. The bypass member upper and lower seals define a chamber isolated from the well fluid in the inner annulus for flowing the gas from the gas passage to the gas outlet.

In one embodiment, each of the well fluid passages has a generally arcuate configuration when viewed in a cross section view perpendicular to an axis of the annular member. The bore of the bypass member may have an axis that is offset relative to an axis of the exterior of the annular member.

A connector at an upper end of the shroud preferably secures the shroud to the string of tubing so as to transfer a weight of the shroud to the string of tubing. In one example, a landing shoulder in the shroud on which the gas separator lands transfers a weight of the gas separator and the pump to the shroud.

BRIEF DESCRIPTION OF THE DRAWINGS

FIG. 5 is a sectional view of an alternate embodiment of a hanger for connecting the assembly of FIG. 1 to a string of production tubing.

FIG. 6 is a top view of a collet, which forms part of the hanger of FIG. 5.

FIG. 7 is a side view of the collet of FIG. 6.

FIG. 9 is a sectional view of a shroud well fluid bypass of the assembly of FIG. 1, taken along the line 9-9 of FIG. 8.

FIG. 11 is a top view of an alternate embodiment of the shroud well fluid bypass member shown in FIG. 9.

FIG. 12 is a sectional view of the shroud well fluid bypass member of FIG. 11, taken along the line 12-12 of FIG. 11.

DETAILED DESCRIPTION OF THE DISCLOSURE

Figure 1A:
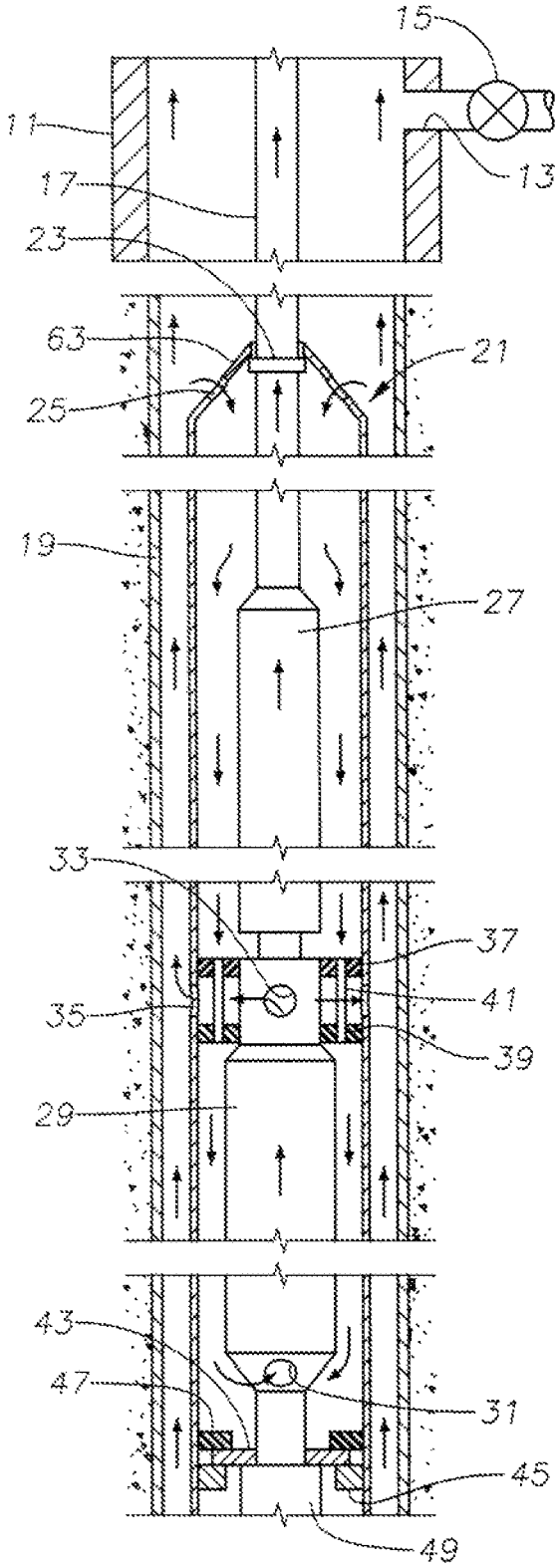
FIGS. 1A and 1B comprise a schematic sectional view of a shrouded electrical submersible pump assembly installed in a well for producing methane from hydrates.
Figure 1B:
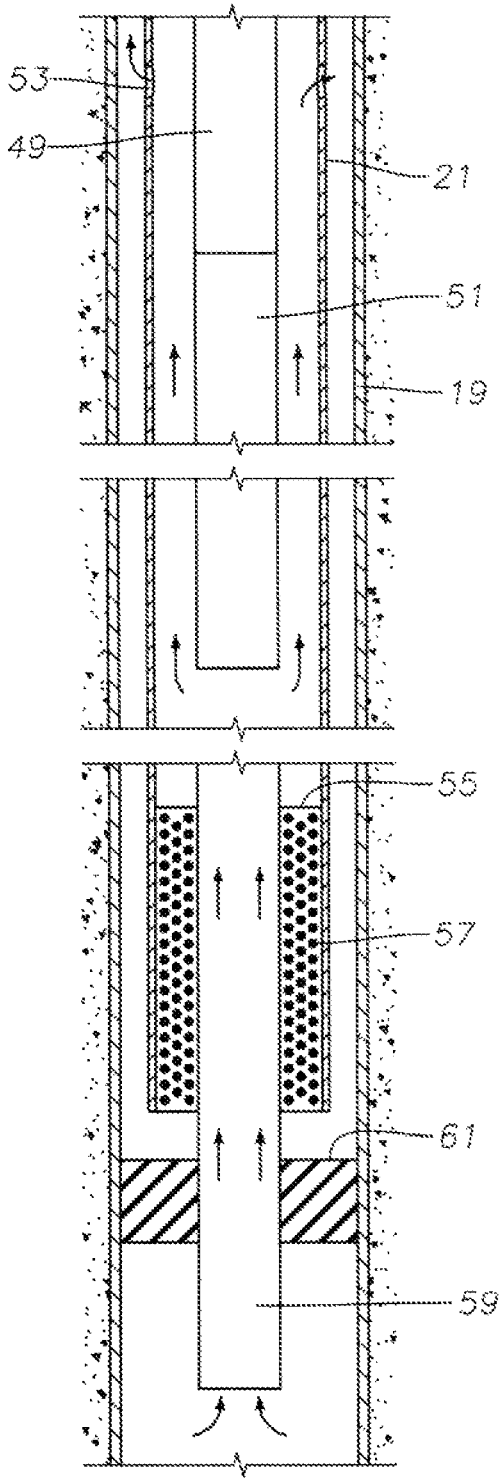

Referring to FIGS. 1A and 1B, a subsea wellhead assembly 11 is schematically illustrated. Wellhead assembly 11 may comprise a subsea production tree and is located at the sea floor. A production flow port 13 with a valve 15 flows gaseous well fluid, such as methane, to a processing facility. A string of production tubing 17 is suspended in wellhead assembly 11 and extends downward into casing 19. Casing 19 is cemented in the well at a depth selected in this example to produce methane from hydrates located at shallow depths below the sea floor. Hydrates exist in a frozen state similar to ice, and contain water as well as methane. The equipment shown in one embodiment of this application will apply heat to the hydrates, which release liquid, principally water, and methane gas. The equipment pumps the water up tubing 17, while the methane gas flows up the outer annulus surrounding tubing 17 in casing 19.

The equipment includes a shroud 21 that comprises pipe such as joints of casing secured together and lowered within casing 19. Shroud 21 may be supported on tubing 19 by various means, including a threaded connection, a clamp 23, or other devices explained subsequently. Shroud 21 has an upper inlet 25 at its upper end for well fluid to enter, as indicated by the arrows. The well fluid will be flowing up casing 19 surrounding an upper portion of shroud 21. As the well fluid turns back downward, lighter gaseous components are released to migrate up casing 19 to wellhead flow port 13.

Tubing 17 extends into shroud 21*a* selected distance and is secured to a discharge of a pump 27. Pump 27 is preferably a centrifugal pump having a large number of stages, each stage comprising an impeller and a diffuser. A gas separator 29 is connected to the lower end of pump 27. Gas separator 29 may be a conventional type employed with electrical submersible pumps. Normally, gas separator 29 will contain vanes within a rotor or drum that is secured to the pump shaft and rotates in unison. The spinning rotor creates centrifugal force that causes denser components of the well fluid to flow radially outward and upward while the gaseous components flow upward within a central area surrounding the shaft. Gas separator 29, which has an intake 31 near it lower end into which the well fluid flows, may also have an inducer to facilitate the flow. Gas separator 29 has a gaseous fluid outlet 33 in its side wall through which the separated lighter components are discharged. Shroud 21 has a gaseous fluid outlet port 35 that communicates with separator gaseous fluid outlet 33 to discharge the gaseous components into the outer annulus on the exterior of shroud 21.

A bypass assembly includes an upper bypass seal 37 that seals the inner annulus between gas separator 29 and shroud 21*a* short distance above gas outlets 33, 35. A lower bypass seal 39 seals the inner annulus between gas separator 29 and shroud 21*a* short distance below gas outlets 33, 35. Bypass seals 37, 39 create an annular sealed chamber in shroud 21 that forces the separated gaseous well fluid out into the outer annulus surrounding shroud 21. The annular seal chamber obviates a need for orienting gas separator gaseous fluid outlet 33 with shroud gaseous fluid outlet port 35.

The heavier or liquid components separated by gas separator 29 flow directly into the lower end of pump 27, which comprises the pump inlet. The separated heavier components do not flow from gas separator 29 into the inner annulus surrounding gas separator 29 and pump 27; rather the heavier components are pumped by pump 27 up production tubing 17.

The bypass assembly also has a plurality of well fluid bypass passages 41 that extend from upper seal 37 to lower seal 39 parallel with the longitudinal axis of shroud 21. Bypass passages 41 are sealed from the gaseous fluid being discharged out shroud outlet 35. Bypass passages 41 are, spaced circumferentially around gas separator 29 and extend through the sealed chamber created by upper bypass seal 37 and lower bypass seal 39. Well fluid that has entered shroud upper inlet 25 at the upper end of shroud 21 flows down the inner annulus between pump 27 and shroud 21. When the well fluid reaches the sealed chamber created by upper and lower bypass seals 37, 39, it bypasses the sealed chamber by flowing through bypass passages 41 down into the inner annulus between gas separator 29 and shroud 21 to gas separator intake 31.

Gas separator 29 has a base plate 43 at its lower end that lands on a shoulder 45 installed within shroud 21 and transfers the weight of pump 27 and gas separator 29 to shroud 21. Base plate 43 has a larger diameter than the central opening through shoulder 45. The housing of gas separator 29 may have the same outer diameter as base plate 43. An inner annulus seal 47 seals between base plate 43 and the inner diameter of shroud 21. Inner annulus seal 47 blocks any downward flowing well fluid in the inner annulus between gas separator 29 and shroud 21 from flowing further downward, thereby forcing all of the downward flowing well fluid into gas separator intake 31. Inner annulus seal 47 defines an upper section and a lower section of shroud 21 sealed from each other. Inner annulus seal 47 prevents any upward flowing well fluid in shroud 21 from flowing upward past gas separator base plate 43. Inner annulus seal 47 could alternately be located on a portion of gas separator 29 above base plate 43 and below gas separator intake 31.

Referring also to FIG. 1B, a seal section or protector 49 for a motor 51 is secured to the lower end of gas separator 29 at base plate 43. Seal section 49 is a conventional component of motor 51 for reducing a pressure differential between well fluid on the exterior of motor 51 and lubricant within motor 51. Typically, seal section 49 has one or more bladders, various seals and a thrust bearing to handle thrust on the motor shaft. Motor 51 may also be conventional and typically comprises a three phase electrical motor. The outer diameters of seal section 49 and motor 51 are smaller than the opening in landing shoulder 45 so that they may pass through. The outer diameters of seal section 49 and motor 51 may be smaller than the outer diameter of gas separator 29.

A shroud well fluid outlet port 53 is located in the side wall of the lower portion of shroud 21, preferably a short distance below landing shoulder 45. Shroud well fluid outlet port 53 is also preferably above the upper end of motor 51. Well fluid will be flowing up the lower portion of shroud 21, as illustrated by the arrows in FIG. 1B, prior to undergoing separation by gas separator 29. The well fluid flows up the inner annulus between the outer diameter of motor 51 and the inner diameter of shroud 21, cooling motor 51. Once the well fluid reaches well fluid outlet port 53, it discharges into the outer annulus between shroud 21 and casing 19.

A heater 55 is secured to shroud 21 below the lower end of motor 51. Heater 55 is axially separated from motor 51 so that the weight of heater 55 is supported by shroud 21, and not by motor 21. Heater 55 may be located on the exterior or within the interior of shroud 21 and is shown schematically. Heater 55 may be an induction type having coils 57 of conductors surrounding a passage through which well fluid flows. A power cable (not shown) for supplying power to heater 55 may extend either within shroud 21 or on the exterior.

A stinger 59 extends downward from shroud 21 below heater 55 and stings through a central opening in a previously installed packer 61. Well fluid from below packer 61 flows into stinger 59, through heater 55 and into the inner annulus surrounding motor 51.

Figure 2:
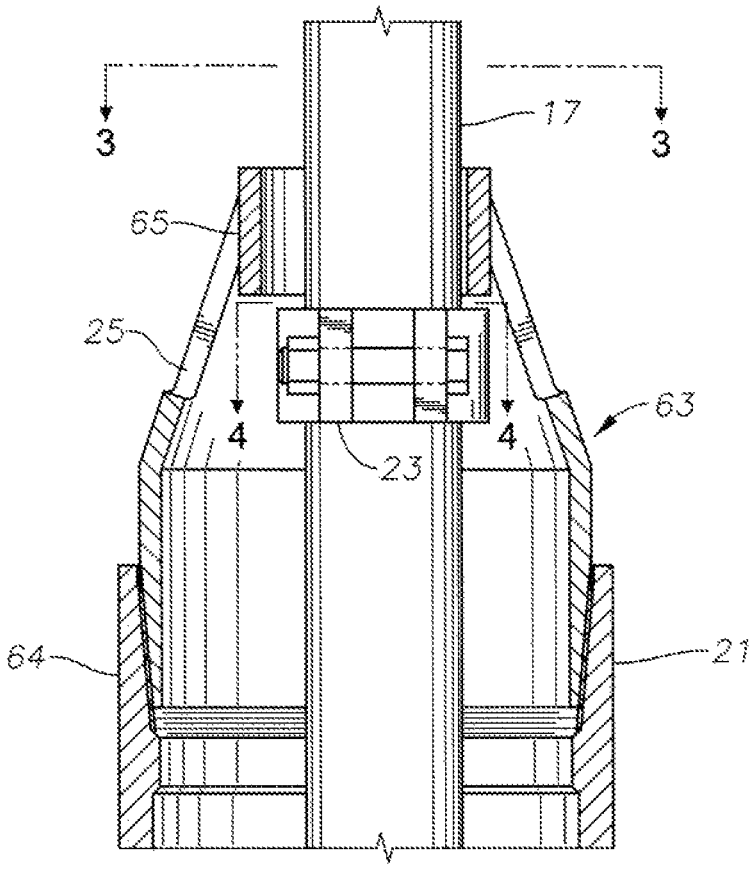
FIG. 2 is a sectional view of a shroud cap with a hanger for connecting the assembly of FIGS. 1A and 1B to a string of production tubing.
Figure 3:
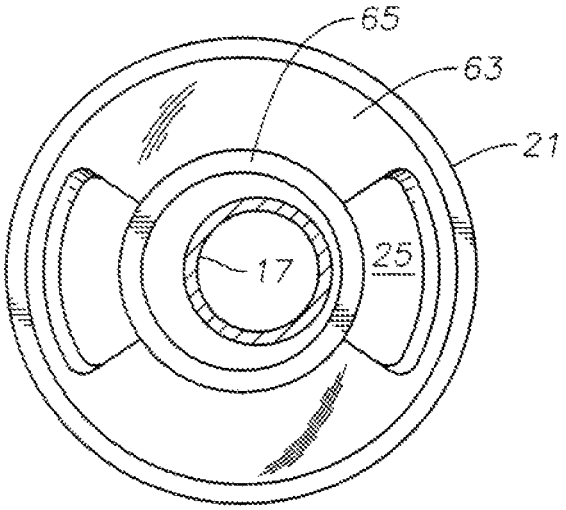
FIG. 3 is an enlarged sectional view of the cap of FIG. 2 taken along the line 3-3 of FIG. 2.
Figure 4:
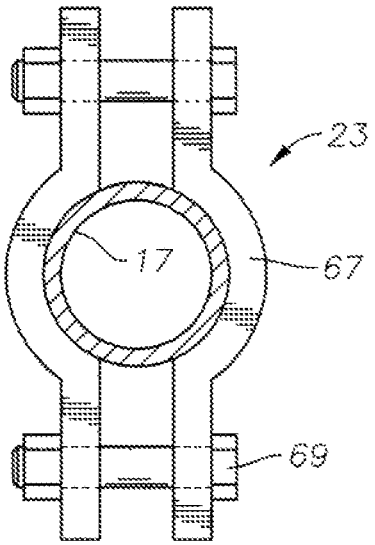
FIG. 4 is an enlarged sectional view of the hanger of the FIG. 2, taken along the line 4-4 of FIG. 2.

FIGS. 2-10 illustrate more details of the components shown in FIGS. 1A and 1B. Referring to FIG. 2, a cap 63 is located at and forms the upper end of shroud 21. Cap 63 preferably secures to a threaded coupling 64 at the upper end of shroud 21. Cap 63 is generally conical, having a circular ring 65 at its upper end. Cap 63 has flow ports 25 formed therein as illustrated in FIG. 3. Ring 65 is concentric with the longitudinal axis of shroud 21. Tubing 19 extends through ring 65 and has a significantly smaller outer diameter than the inner diameter of ring 65. Preferably tubing 19 as well as pump 27, gas separator 29 and motor 61 are offset to one side from the axis of shroud 21. The lower end of upper ring 65 rests on the upper side of clamp 25, transferring all of the weight of shroud 21, pump 27, gas separator 29, motor 51 and heater 55 (FIGS. 1A and 1B) to tubing 17. As shown in FIG. 4, clamp 23 may comprise two clamp members 67, each having a partially cylindrical portion to fit around tubing 17. Bolts 69 attach opposite ends of clamp members 67 to each other, creating a frictional grip of tubing 17. Grooves could be located on the exterior of tubing 17 and interior of clamp members 67 to facilitate the gripping engagement.

FIGS. 5-7 illustrate an alternate embodiment for supporting shroud 21 on tubing 17. In this embodiment, a set of slips or a collet 71 has collet elements 71*a* and 71*b*. Each collet element 71*a*, 71*b* has an outer surface that is conical and mates with a conical inner surface of cap ring 79. Also grooves 73 may be formed on the inner surfaces of the collet elements 71*a* and 71*b* to mate with similar grooves on the outer diameter of tubing 17. Grooves 73 may be parallel, circumferential grooves or they may comprise threads. The inner surfaces 74 of the collet elements 71*a*, 71*b* are semi-cylindrical. As shown in FIG. 6, when collet elements 71*a*, 71*b* placed together as shown in FIG. 6, they define a cylindrical opening for receiving tubing 17. The opening is offset from longitudinal axis 77. The outer surface 72 of collet 71 forms a diametrical surface that is concentric with axis 77. The inner surface 74 of collet 71 defines an inner diameter that is offset relative to axis 77. Each collet element 71*a*, 71*b* extends slightly under 180 degrees, which positions their ends 75 adjacent but not touching each other. Collet element 71*a* is thicker in a radial direction than collect element 71*b* as a result of the offset inner diameter 74. The conical outer surfaces 72 sliding down the conical inner surface of upper ring 79 force collet elements 71*a*, 71*b* tightly around tubing 17

As shown in FIG. 7, two collets 71 may be used, with one inverted relative to the other to also prevent upward and downward movement of shroud 21 relative to tubing 17. Also, as shown in FIG. 5, two clamps 23 may be employed, with one clamp 23 below the lower collet 71 and one clamp 23 above the upper collet 71. Each collet 71 could comprise three or more collet elements, rather than two.

Figure 8:
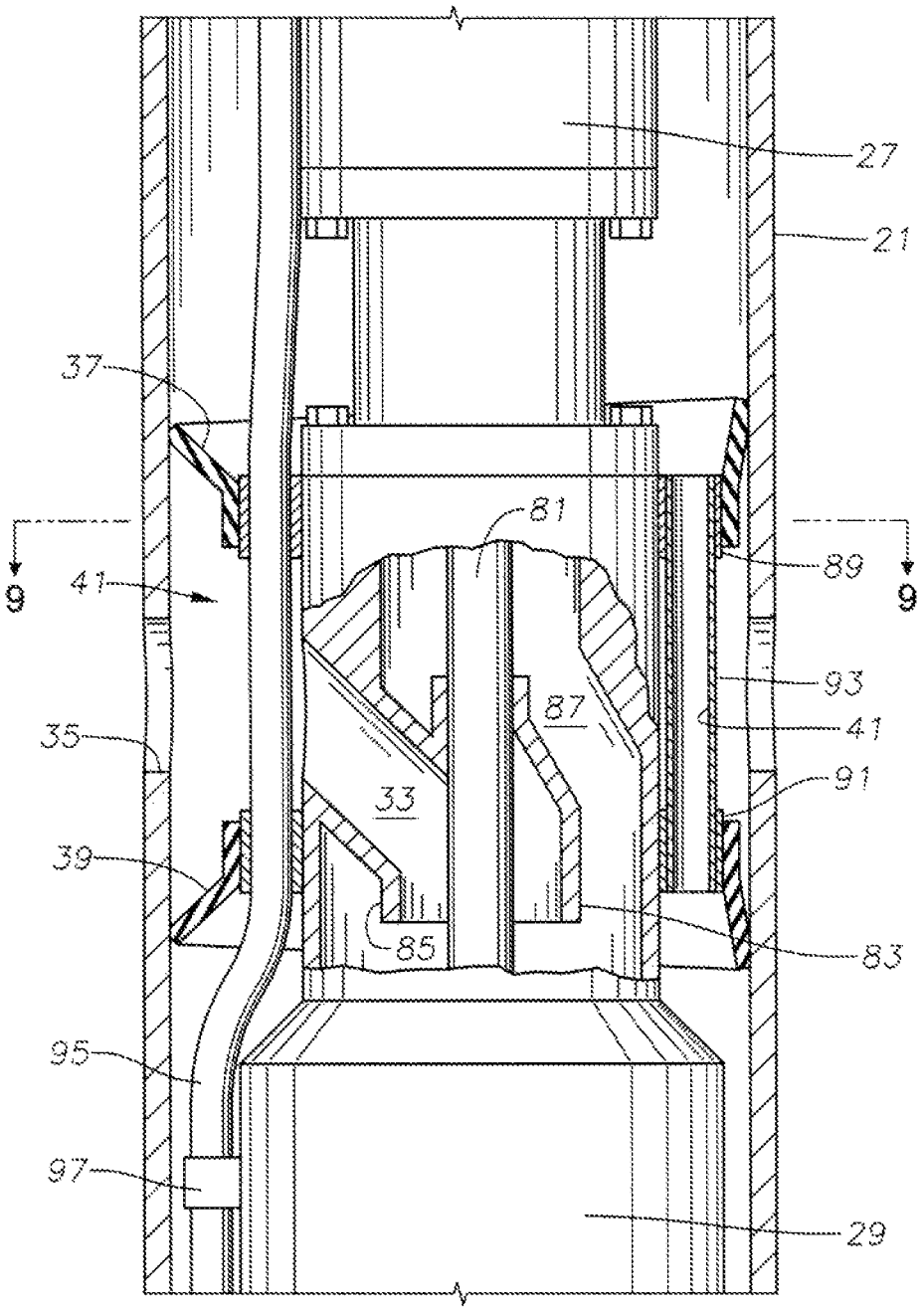
FIG. 8 is a sectional view of an upper portion of the gas separator of the assembly of FIGS. 1A and 1B.

Referring to FIG. 8, a drive shaft 81 extending upward from motor 51 (FIG. 1B) extends through gas separator 29. Drive shaft 81 may comprise multiple shafts coupled together. Gas separator 29 has a crossover member 83, which has a central opening through which drive shaft 81 passes. Crossover member 83 is located within the upper end of gas separator 29 and has a cylindrical downward extending skirt 85. Gaseous fluid outlet 33 extends upward and outward from skirt 85. Skirt 85 has a smaller outer diameter than the inner diameter of gas separator 29 at that point, resulting in an annular passage 87 between skirt 85 and the inner diameter of gas separator 29 for the separated heavier components of the well fluid. Heavier fluid passage 87 extends into the interior lower end of pump 27.

Bypass passages 41 are shown in more detail in FIG. 8. In this example, the bypass member comprises axially spaced apart upper and lower rings 89, 91 secured around the upper portion of gas separator 29. Tubes 93 extend through and between each ring for transmitting downward flowing well fluid. Tubes 93 are equally spaced around the circumference of the upper portion of gas separator 29, as shown in FIG. 9. Upper bypass seal 37 and lower bypass seal 39 may be secured to upper and lower rings 89, 91, respectively. In this example, each seal 37, 39 is a cup seal comprising an elastomeric member that is conically shaped. Because of gas separator 29 and pump 27 being offset in shroud 21, the portion of each seal 37, 39 on the closer side (shown to be on the right) is more deformed than on the farther side. Cup seals 37, 39 facilitate sliding pump 27 and gas separator 29 into shroud 21.

As shown in FIGS. 8 and 9, one of the openings within bypass passage rings 89, 91 is configured for a motor power cable or lead 95 to be inserted through. Typically, the portion of motor lead 95 alongside pump 27 and gas separator 29 is flat or generally rectangular as shown in FIG. 9.

The offset of pump 27, gas separator 29 and motor 51 relative to the longitudinal axis of shroud 21 is caused by cable protectors 97 mounted alongside these components over motor lead 95. Each cable protector 97 creates a standoff, pushing the electrical submersible pump assembly to one side of shroud 21.

Figure 10:
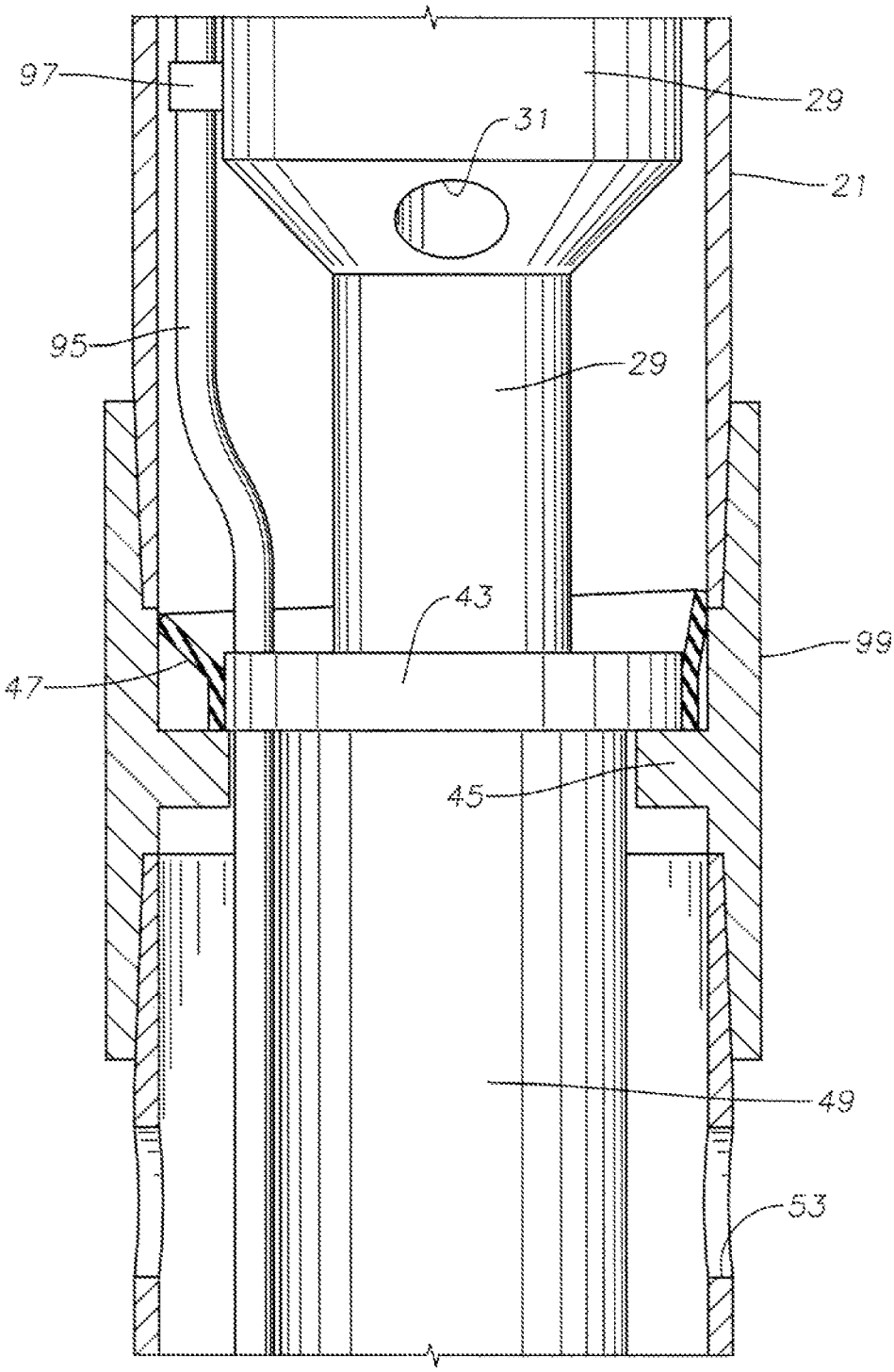
FIG. 10 is a sectional view of the base of the gas separator of the assembly of FIGS. 1A and 1B.

Referring to FIG. 10, in this example, landing shoulder 45 is formed within the inner diameter of a threaded coupling 99. Coupling 99 secures together two separate pipes or casing joints that make up part of shroud 21. Also, as shown in FIG. 10, inner annulus seal 47 may be the same type of cup seal as upper and intermediate seals 37, 39 (FIG. 8). Inner annulus seal 47 may be attached to the circumference of gas separator base plate 43.

To assemble the equipment shown in FIGS. 1A and 1B, the well will first be drilled and cased with casing 19. Packer 61 is then installed. The operator secures stinger 59 and heater 55 to a lower portion of shroud 21, then makes up shroud 21 while lowering it into the casing 19. The power cable to heater 55 will be separate from pump motor power cable 95 (FIG. 10) and may extend alongside the exterior of shroud 21. When the upper end of shroud 21 is at the rig floor, the operator sets slips to suspend the upper end of shroud 21 at the rig floor. The operator makes up the electrical submersible pump assembly comprising motor 51, seal section 49, gas separator 29 and pump 27. The operator lowers the pump assembly on tubing 17 into shroud 21 while it is still suspended at the rig floor. Motor power cable 95 is fed into shroud 21 and secured alongside the electrical submersible pump assembly with cable protectors 97. Seal section 49 and motor 51 will pass through landing shoulder 45. Gas separator base plate 43 will land on landing shoulder 45, which positions gas separator gaseous outlet 33 in vertical alignment with shroud gaseous fluid outlet 35. Orientation of gas separator outlet 33 with shroud outlet 35 is not necessary because of the annular chamber created by seals 37, 39, which will be above and below outlets 33, 35.

The operator then installs cap 63 and secures clamp 23 and optionally collets 71 to tubing 17. The operator lifts tubing 17 a short distance, which causes clamp 23 to abut ring 65 and lift shroud 21 to release the slips at the rig floor. The operator then lowers the entire assembly on tubing 17 through wellhead assembly 11 and into casing 19. The operator will likely employ a riser extending between wellhead assembly 11 and the drilling rig if the water is deep enough to require one. If so, the entire assembly is lowered on tubing 17 through the riser.

When the installation is complete, the operator causes heater 55 to heat hydrates in the vicinity, which results in water and methane gas evolving. The operator turns on pump motor 51, which causes a mixture of water and methane to flow up stinger 59, through the inner annulus between motor 51 and the lower part of shroud 21 and out well fluid outlet 53 (FIG. 1B). The mixture of water and gas flows from outlet 53 up the outer annulus between shroud 21 and casing 19 to the open ports 25 at the upper end of shroud 21. The action of pump 27 draws the well fluid downward into the inner annulus between pump 27 and shroud 21. As the well fluid changes direction from upward to downward, a significant portion of the gas will separate and migrate upward in casing 19. At wellhead assembly 11, the gas passes through port 11 and valve 15 to a processing facility.

The downward flowing more dense well fluid passes through bypass passages 41 to the intake of gas separator 29. Gas separator 29 further separates gas from liquid, with the gaseous component being discharged out gaseous outlet 33 into the outer annulus. The separated gaseous component encounters well fluid flowing upward after being discharged from shroud well fluid outlet 53. The separated gaseous fluid mixes to some extent with the well fluid flowing upward. A significant amount of this gaseous fluid will separate when the well fluid turns to flow downward into shroud 21 through upper ports 25. This separated gas will flow upward through casing 19 to wellhead assembly 11. The heavier components separated by gas separator 29 are pumped by pump 27 up tubing 17 and are delivered from wellhead 21 to a facility for treatment and disposal. A control system will monitor conditions in the well and control pump 27 and heater 55 accordingly.

FIGS. 11 and 12 show an alternate embodiment to bypass passages 41 (FIGS. 8 and 9). Bypass member 101 is a cylindrical, tubular member having a bore 103 and a generally cylindrical exterior 105. A wall 107 is defined between bore 103 and exterior 105. Bore 103 is centered on an axis 109 that is offset and parallel to exterior axis 111. Exterior 105 is centered on exterior axis 111. Because of bore 103 being offset, the thickness of wall 107 gradually varies when measured around the circumference of wail 107. The portion of wall 107 shown on the right side of FIG. 11 is thinner than the portion shown on the left side.

Well fluid passages 113 extend through wall 107 from the upper end to the lower end parallel with axes 109, 111. In this example, there are three well fluid passages 113*a*, 113*b* and 113*c*, but the number could differ. Optionally, well fluid passage 113*c* may have a greater flow area than well fluid passage 113*a*, which in turn is greater than well fluid passage 113*b*. Each well fluid passage 113 may extend circumferentially the same angular distance, which in this example is approximately 60 degrees. The width of each well fluid passage 113 increases in a direction from a thinner portion of wall 107 to a thicker portion of wall 107. Each well fluid passage 113 thus has a smaller width end 115 and a larger width end 117. Also, the smaller width end 115 of well fluid passage 113*e* is wider than the wider width end 117 of well fluid passage 113*b* in this example. The wider ends 117 of well fluid passages 113*b* and 113*c* may be adjacent each other. The smaller width ends 115 of well fluid passage 113*a* and 113*b* may be adjacent each other.

Gas passages 119 extend through wall 107 in a lateral direction, perpendicular to axes 109, 111. In this example, there are three gas passages 119, and each is located between two of the well fluid passages 113. Each gas passage 119 extends from bore 103 to exterior 105 for directing separated gas out on of the shroud gas outlets 35 (FIG. 8). Bypass member 101 has an annular upper seal 121 and one or more annular lower seals 123. Upper seal 121 is located above gas passages 119 and seals against the inner surface of shroud 21 above shroud gas outlet 35 (FIG. 8). Seals 123 are below gas passages 119 and seal against the inner surface of shroud 21 below shroud gas outlets 35. Seals 121 and 123 may be O-ring seals. The portion of exterior 105 into which gas outlets 119 extend is slightly smaller in outer diameter than the portion of exterior 105 that contains seals 121, 123. Seals 121, 123 thus create an annular sealed chamber surrounding bypass member 101 that communicates gas passages 119 with shroud gas outlet 35 even if not oriented in alignment with each other.

Bore 103 is configured to closely receive the exterior of gas separator 29 at cross over member 83. Each gas passage 19 will be radially oriented or aligned with gas outlets 33 (FIG. 8) of gas separator 29. A retainer ring (not shown) or other fastener may secure bypass member 101 in place. The power cable 95 (FIG. 8) of motor 51 (FIG. 1B) passes through one of the well fluid passages 113. When pump 27, gas separator 29 and motor 51 (FIGS. 1A, 1B), are lowered into shroud 21, seals 121, 123 slide downward in shroud 21 until gas separator base 43 lands on shroud internal shoulder 45. At that point, bypass member gas passages 119 will be vertically aligned with shroud gas outlets 35.

While shown in only a few of its forms, it should be apparent to those skilled in the art that it is susceptible to various modifications. For example, although shown in connection with a system for producing methane from hydrates, much of the assembly may be used in wells that produce oil and/or gas and water. The heater might not be required in an oil and gas well.

The invention claimed is:

1. An apparatus for pumping a gaseous well fluid, comprising:

a shroud supported by a string of tubing within a well to define an outer annulus surrounding the shroud, the shroud having an upper section and a lower section sealed from one another, the upper section having an upper inlet and a gas outlet;

a submersible pump housed within the upper section of the shroud and having an upper end for connection to the string of tubing;

a gas separator connected to a lower end of the pump and housed within the upper section of the shroud;

the gas separator having an intake at a lower end of the gas separator in fluid communication with well fluid in the shroud entering through the upper inlet, the gas separator having a liquid outlet in fluid communication with an intake of the pump, and a gas outlet in fluid communication with the gas outlet in the shroud;

a motor housed within the lower section of the shroud, the motor being coupled to the gas separator for driving the gas separator and the pump; and a well fluid lower inlet in the shroud below the motor and a well fluid lower outlet in the lower section of the shroud above the motor for flowing well fluid into the shroud and past the motor to the well fluid lower outlet.

2. The apparatus according to claim 1, further comprising:

a well fluid bypass member having an upper end, a lower end, and a bore in which a portion of the gas separator is located, defining a wall between the bore and an exterior of the bypass member;

a plurality of well fluid passages extending through the wall of the bypass member from the upper end to the lower end of the bypass member to define the well fluid flow path to the intake of the gas separator;

at least one gas passage extending through the wall of the bypass member from the bore to the exterior, the gas passage being in fluid communication with the gas outlet of the gas separator and the gas outlet of the shroud;

a bypass member upper seal sealing between the bypass member and the shroud above the gas outlet of the shroud; and a bypass member lower seal sealing between the bypass member and the shroud below the gas outlet of the shroud, the bypass member upper and lower seals defining a chamber isolated from the well fluid in the inner annulus for flowing the gas from the gas passage to the gas outlet.

3. The apparatus according to claim 2, wherein each of the well fluid passages has a generally arcuate configuration when viewed in a cross section view perpendicular to an axis of the pass member.

4. The apparatus according to claim 2, wherein the bore has an axis that is offset relative to an axis of the exterior of the bypass member.

5. The apparatus according to claim 1 further comprising:

a connector at an upper end of the shroud for securing the shroud to the string of tubing so as to transfer a weight of the shroud to the string of tubing; and a landing shoulder in the shroud on which the gas separator lands, transferring a weight of the gas separator and the pump to the shroud.

6. An apparatus for pumping a gaseous well fluid, comprising:

a shroud supported by a string of tubing for location within a well to define an outer annulus surrounding the shroud;

the shroud having a lower inlet at a lower end, an upper inlet at an upper end, a lower outlet, and an upper outlet, the lower outlet and the upper outlet being located between the lower inlet and the upper inlet;

a submersible pump assembly housed within the shroud, defining an inner annulus between the pump assembly and the shroud, the pump assembly including a motor, a pump located above the motor, and a gas separator located between the motor and the pump;

the gas separator having an intake at a lower end of the gas separator in fluid communication with the inner annulus;

the gas separator having a crossover member at an upper end of the gas separator having a liquid outlet in fluid communication with an intake of the pump, and a gas outlet;

a well fluid bypass member located within the inner annulus, the bypass member having a gas conduit providing a gas flow path between the gas outlet of the crossover member and the upper outlet of the shroud that is sealed from well fluid within the inner annulus;

the bypass member defining a well fluid flow path within the inner annulus for allowing well fluid flowing into the upper inlet of the shroud to flow downward to the intake of the gas separator; and an inner annulus seal sealing between the pump assembly and the shroud below the gas separator and above the motor and the lower outlet of the shroud, forcing well fluid flowing into the lower inlet of the shroud to flow up the inner annulus past the motor and out the lower outlet to the outer annulus.

7. The apparatus according to claim 6, wherein the bypass member further comprises:

an upper bypass member seal sealing between the bypass member and the shroud above the upper outlet of the shroud;

a lower bypass member seal sealing between the bypass member and the shroud below the upper outlet of the shroud; and wherein the seals define an annular chamber between the bypass member and the shroud, eliminating a need for orienting the gas conduit of the bypass member with the upper outlet of the shroud.

8. The apparatus according to claim 6, wherein the bypass member comprises:

an annular member having an upper end, a lower end, and a bore in which a portion of the gas separator extends, defining a wall between the bore and an exterior of the annular member;

a plurality of well fluid passages extending through the wall of the annular member from the upper end to the lower end of the annular member to define the well fluid flow path; and each of the well fluid passages has a generally arcuate configuration when viewed in a cross section view perpendicular to an axis of the annular member.

9. The apparatus according to claim 6, wherein:

wherein the bypass member comprises:

an annular member having an upper end, a lower end, and a bore in which the crossover member extends, defining a wall between the bore and an exterior of the annular member;

a plurality of well fluid passages extending through the wall of the annular member from the upper end to the lower end of the bypass member to define the well fluid flow path; and wherein the bore has an axis that is offset relative to an axis of the exterior of the annular member.

10. The apparatus according to claim 6, wherein:

the motor is an electrical motor; and a power cord extends from the upper end of the shroud down the inner annulus to the motor.

11. The apparatus according to claim 10, wherein:

the pump assembly is located offset within the shroud from an axis of the shroud to accommodate the power cord.

12. The apparatus according to claim 11, wherein the bypass member has a passage extending from an upper end to a lower end of the bypass member, and the power cord extends through the passage.

13. The apparatus according to claim 6, further comprising:

a connector at the upper end of the shroud that for securing the shroud to the string of tubing and transferring a weight of the shroud to the string of tubing; and a landing shoulder in the shroud on which the pump assembly lands for transferring a weight of the pump assembly to the shroud.

14. The apparatus according to claim 6, further comprising:

a heater located within the shroud below the motor for heating well fluid flowing into the lower inlet of the shroud.

15. The apparatus according to claim 14, wherein an upper end of the heater is located a selected distance below a lower end of the motor, enabling the pump assembly to be lowered into the shroud after the heater has been installed in the shroud.

16. The apparatus according to claim 6, wherein the inner annulus seal is mounted to the pump assembly and is capable of sliding movement against an inner wall surface of the shroud as the pump assembly is lowered into the shroud.

17. A method of producing a well, comprising:

(a) providing a submersible pump assembly with a motor, a pump, and a gas separator located between the motor and the pump;

(b) installing the pump assembly in a shroud and with an inner annulus seal, sealing between the pump assembly and the shroud at a location between the gas separator and the motor;

(c) installing the shroud and the pump assembly in the well;

(d) flowing well fluid into a lower inlet of the shroud, past the motor and out a lower outlet of the shroud located below the inner annulus seal and into an outer annulus surrounding the shroud;

(e) flowing some of the well fluid flowing up the outer annulus downward into an upper inlet of the shroud and into the inner annulus, causing some of the gaseous components to separate and flow up the well;

(f) directing the well fluid flowing down the inner annulus to the gas separator, separating additional gaseous components with the gas separator and discharging the additional gaseous components through a gas outlet of the shroud into the stream of well fluid flowing up the outer annulus; and (g) directing liquid separated by the separator to the pump and pumping the well fluid up the well.

18. The apparatus according to claim 17, wherein:

step (c) comprises landing the pump assembly on a shoulder in the shroud and transferring a weight of the pump assembly to the shroud while an upper end of the shroud is supported at a rig floor; and step (d) comprises securing an upper end of the shroud to a string of tubing, transferring a weight of the shroud to the string of tubing, and lowering the shroud and the pump assembly into the well with the string of tubing.

19. The method according to claim 18, wherein securing an upper end of the shroud to the string of tubing comprises first securing a clamp around the string of tubing, and then lowering an upper portion of the upper end of the shroud onto the clamp.

20. The method according to claim 17, further comprising:

installing a heater within the shroud below the motor; and operating the heater to heat the well fluid flowing into the lower inlet of the shroud.

* * * * *